US010474108B2

(12) United States Patent
Guo

(10) Patent No.: US 10,474,108 B2
(45) Date of Patent: Nov. 12, 2019

(54) MAGNETIC SENSOR ARRAY FOR CROWN ROTATION

(71) Applicant: Apple Inc., Cupertino, CA (US)

(72) Inventor: Jian Guo, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 4 days.

(21) Appl. No.: 15/717,782

(22) Filed: Sep. 27, 2017

(65) Prior Publication Data

US 2019/0094811 A1 Mar. 28, 2019

(51) Int. Cl.
*G04C 3/00* (2006.01)
*G04G 17/08* (2006.01)

(52) U.S. Cl.
CPC ..... *G04C 3/004* (2013.01); *G04G 17/08* (2013.01)

(58) Field of Classification Search
CPC ..... G04C 3/004; G06F 3/0362
See application file for complete search history.

(56) References Cited

U.S. PATENT DOCUMENTS

| | | | |
|---|---|---|---|
| 5,483,261 | A | 1/1996 | Yasutake |
| 5,488,204 | A | 1/1996 | Mead et al. |
| 5,825,352 | A | 10/1998 | Bisset et al. |
| 5,835,079 | A | 11/1998 | Shieh |
| 5,880,411 | A | 3/1999 | Gillespie et al. |
| 6,188,391 | B1 | 2/2001 | Seely et al. |
| 6,310,610 | B1 | 10/2001 | Beaton et al. |
| 6,323,846 | B1 | 11/2001 | Westerman et al. |
| 6,690,387 | B2 | 2/2004 | Zimmerman et al. |
| 7,015,894 | B2 | 3/2006 | Morohoshi |
| 7,184,064 | B2 | 2/2007 | Zimmerman et al. |
| 7,663,607 | B2 | 2/2010 | Hotelling et al. |
| 8,305,171 | B2 | 11/2012 | Kimura et al. |

(Continued)

FOREIGN PATENT DOCUMENTS

| | | | |
|---|---|---|---|
| CN | 204650147 | U | 9/2015 |
| JP | 2000-163031 | A | 6/2000 |
| JP | 2002-342033 | A | 11/2002 |

OTHER PUBLICATIONS

Lee, S.K. et al. (Apr. 1985). "A Multi-Touch Three Dimensional Touch-Sensitive Tablet," *Proceedings of CHI: ACM Conference on Human Factors in Computing Systems*, pp. 21-25.

(Continued)

*Primary Examiner* — Daniel P Wicklund
(74) *Attorney, Agent, or Firm* — Kubota & Basol LLP

(57) ABSTRACT

An electronic device is disclosed. In some examples, a crown comprising a housing can be operatively coupled to a body of the electronic device, and configured to rotate in a first direction with respect to the body of the electronic device in response to a mechanical input provided by the user. A rotating member can be disposed at least partially inside the crown housing and configured to rotate in the first direction in response to the mechanical input. A first magnetic sensing cell can be attached to the rotating member at a first location of the rotating member and can be electrically connected to an electronic circuit. A magnet can be configured to remain stationary with respect to the body of the electronic device. The electronic circuit can be configured to generate a first signal corresponding to a rotational position of the crown with respect to the body of the electronic device.

19 Claims, 12 Drawing Sheets

(56) References Cited

U.S. PATENT DOCUMENTS

| | | | | |
|---|---|---|---|---|
| 8,479,122 | B2 | 7/2013 | Hotelling et al. | |
| 8,783,944 | B2 | 7/2014 | Doi | |
| 9,223,296 | B2 | 12/2015 | Yang et al. | |
| 9,256,209 | B2 | 2/2016 | Yang et al. | |
| 9,709,956 | B1 | 7/2017 | Ely et al. | |
| 9,728,035 | B2 * | 8/2017 | Faul | G07F 17/3206 |
| 9,753,436 | B2 | 9/2017 | Ely et al. | |
| 9,971,407 | B2 * | 5/2018 | Holenarsipur | G06F 3/016 |
| 10,007,290 | B2 * | 6/2018 | Battlogg | G05G 5/03 |
| 2002/0057152 | A1 * | 5/2002 | Elferich | G05G 1/08 335/220 |
| 2006/0001657 | A1 * | 1/2006 | Monney | G06F 3/0312 345/184 |
| 2006/0055582 | A1 * | 3/2006 | Wendt | G08C 17/02 341/175 |
| 2006/0197753 | A1 | 9/2006 | Hotelling | |
| 2015/0350146 | A1 | 12/2015 | Cary et al. | |
| 2016/0069712 | A1 | 3/2016 | Holenarsipur et al. | |
| 2016/0378071 | A1 | 12/2016 | Rothkopf | |
| 2017/0003655 | A1 | 1/2017 | Ely | |
| 2017/0045958 | A1 * | 2/2017 | Battlogg | A61F 2/38 |
| 2017/0262083 | A1 * | 9/2017 | Huang | G06F 3/03543 |
| 2018/0059624 | A1 * | 3/2018 | James | G04C 3/001 |
| 2018/0210562 | A1 * | 7/2018 | Kao | G06F 3/03543 |
| 2018/0308649 | A1 * | 10/2018 | Kubes | G05G 5/03 |

OTHER PUBLICATIONS

Rubine, D.H. (Dec. 1991). "The Automatic Recognition of Gestures," CMU-CS-91-202, Submitted in Partial Fulfillment of the Requirements for the Degree of Doctor of Philosophy in Computer Science at Carnegie Mellon University, 285 pages.

Rubine, D.H. (May 1992). "Combining Gestures and Direct Manipulation," CHI '92, pp. 659-660.

Westerman, W. (Spring 1999). "Hand Tracking, Finger Identification, and Chordic Manipulation on a Multi-Touch Surface," A Dissertation Submitted to the Faculty of the University of Delaware in Partial Fulfillment of the Requirements for the Degree of Doctor of Philosophy in Electrical Engineering, 364 pages.

* cited by examiner

MAGNETIC SENSOR ARRAY FOR CROWN ROTATION

FIELD OF THE DISCLOSURE

This relates generally to user inputs, such as rotational inputs, and more particularly, to using magnetic sensing to detect a rotational input.

BACKGROUND OF THE DISCLOSURE

Many types of input devices are presently available for performing operations in a computing system, such as buttons or keys, mice, trackballs, joysticks, touch sensor panels, touch screens and the like. Touch screens, in particular, are becoming increasingly popular because of their ease and versatility of operation as well as their declining price. Touch screens can include a touch sensor panel, which can be a clear panel with a touch-sensitive surface, and a display device such as a liquid crystal display (LCD) that can be positioned partially or fully behind the panel so that the touch-sensitive surface can cover at least a portion of the viewable area of the display device. Touch screens can allow a user to perform various functions by touching the touch sensor panel using a finger, stylus or other object at a location often dictated by a user interface (UI) being displayed by the display device. In general, touch screens can recognize a touch and the position of the touch on the touch sensor panel, and the computing system can then interpret the touch in accordance with the display appearing at the time of the touch, and thereafter can perform one or more actions based on the touch. In the case of some touch sensing systems, a physical touch on the display is not needed to detect a touch. For example, in some capacitive-type touch sensing systems, fringing electrical fields used to detect touch can extend beyond the surface of the display, and objects approaching near the surface may be detected near the surface without actually touching the surface.

In addition to touch panels/touch screens, many electronic devices may also have mechanical inputs (or mechanical input mechanisms), such as buttons, switches, and/or knobs. These mechanical inputs can control power (i.e., on/off) and volume for the electronic devices, among other functions. However, interfacing mechanical inputs, particularly rotational mechanical inputs, to an electronic device may require electronic instrumentation which may be difficult to integrate into the electronic device, for example because the instrumentation may be undesirably large, may require high power consumption, or may require complex processing, or may be subject to environmental interference. Further, conventional technologies for providing rotational mechanical input can exhibit limited dynamic range and non-linear response, both of which can complicate integration of the mechanical input into larger systems.

SUMMARY OF THE DISCLOSURE

The present disclosure relates to magnetic sensors for enabling inputs for manipulating a user interface on a wearable electronic device using a mechanical rotary input (e.g., a crown). In some examples, a crown comprising a housing can be operatively coupled to a body of the electronic device, and configured to rotate in a first direction with respect to the body of the electronic device in response to a mechanical input provided by the user. A rotating member can be disposed at least partially inside the crown housing and configured to rotate in the first direction in response to the mechanical input. A first magnetic sensing cell can be attached to the rotating member at a first location of the rotating member and can be electrically connected to an electronic circuit. A magnet can be configured to remain stationary with respect to the body of the electronic device. The electronic circuit can be configured to generate a first signal corresponding to a rotational position of the crown with respect to the body of the electronic device.

DETAILED DESCRIPTION

In the following description of examples, reference is made to the accompanying drawings in which it is shown by way of illustration specific examples that can be practiced. It is to be understood that other examples can be practiced and structural changes can be made without departing from the scope of the disclosure.

Figure 1:
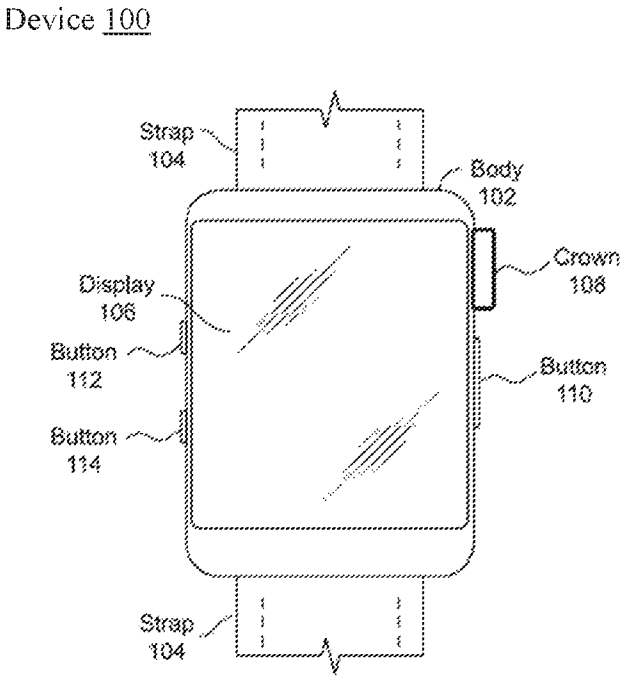
FIG. 1 illustrates an exemplary personal device in which the rotational input sensing of the disclosure can be implemented according to examples of the disclosure.

FIG. 1 illustrates exemplary personal electronic device 100 in which the sensing of the disclosure can be implemented according to examples of the disclosure. In the illustrated example, device 100 can be a watch that generally includes body 102 and strap 104 for affixing device 100 to the body of a user. That is, device 100 can be wearable. Body 102 can be designed to couple to straps 104. Device 100 can have touch-sensitive display screen 106 (hereafter touchscreen) and crown 108. Device 100 can also have buttons 110, 112, and 114. Though device 100 is illustrated as being a watch, it is understood that the examples of the disclosure can be implemented in devices other than watches, such as tablet computers, mobile phones, or any other wearable or non-wearable electronic device that can include a rotary input such as a crown. Device 100 may be viewed as a host device with respect to crown 108.

Conventionally, the term 'crown,' in the context of a watch, can refer to the cap atop a stem or shaft for winding the watch. In the context of a personal electronic device 100, the crown can be a physical component of the electronic device, rather than a virtual crown on a touch sensitive display. Crown 108 can be mechanical, meaning that it can be connected to a sensor for converting physical movement of the crown into electrical signals. Crown 108 can rotate in two directions of rotation (e.g., forward and backward, or clockwise and counter-clockwise). Crown 108 can also be pushed in toward the body 102 of device 100 and/or be pulled away from the device. Crown 108 can be touch-sensitive, for example, using capacitive touch technologies or other suitable technologies that can detect whether a user is touching the crown. Moreover, in some examples, crown 108 can further be configured to tilt in one or more directions or slide along a track at least partially around a perimeter of body 102. In some examples, more than one crown 108 can be included in device 100. The visual appearance of crown 108 can, but need not, resemble crowns of conventional watches. Buttons 110, 112, and 114, if included, can each be a physical or a touch-sensitive button. That is, the buttons may be, for example, physical buttons or capacitive buttons. Further, body 102, which can include a bezel, may have predetermined regions on the bezel that act as buttons.

Display 106 can include a display device, such as a liquid crystal display (LCD), light-emitting diode (LED) display, organic light-emitting diode (OLED) display, or the like, positioned partially or fully behind or in front of a touch sensor panel implemented using any desired touch sensing technology, such as mutual-capacitance touch sensing, self-capacitance touch sensing, resistive touch sensing, projection scan touch sensing, or the like. Display 106 can allow a user to perform various functions by touching or hovering near the touch sensor panel using one or more fingers or other objects.

Figure 2:
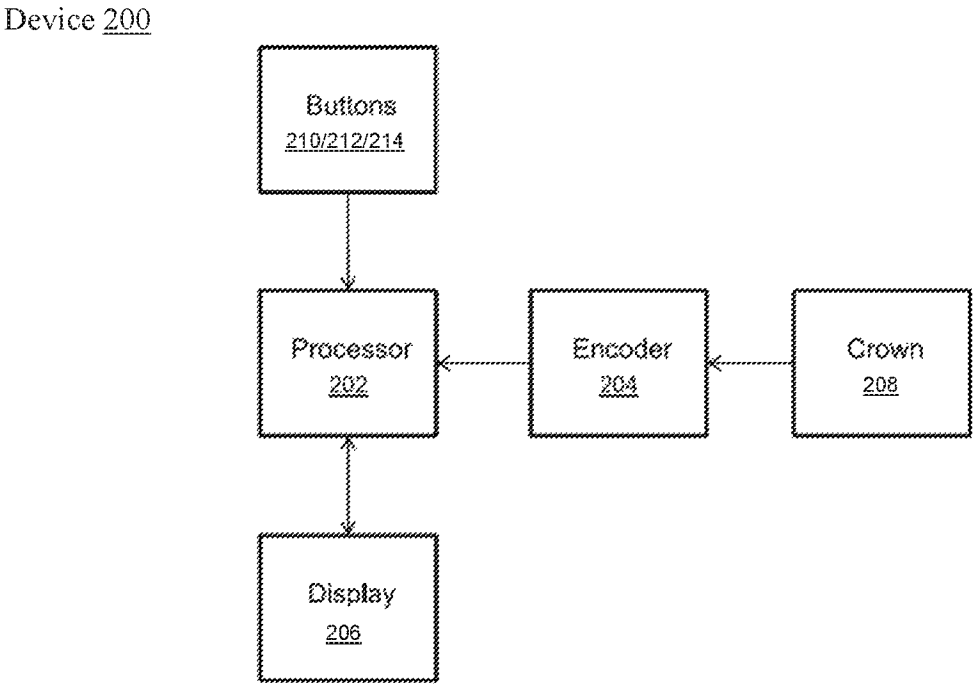
FIG. 2 illustrates an exemplary block diagram of components within an exemplary device according to examples of the disclosure.

FIG. 2 illustrates an exemplary block diagram of components within an exemplary device 200 according to examples of the disclosure. In some examples, crown 208 (which can correspond to crown 108 described above) can be coupled to encoder 204, which can be configured to monitor a physical state or change of physical state of the crown (e.g., the position and/or rotational state of the crown), convert it to an electrical signal (e.g., convert it to an analog or digital signal representation of the position or change in position of the crown), and provide the signal to processor 202 (which may be viewed as a host processor). In some examples, crown 208 (which can correspond to crown 108 described above) can be coupled to encoder 204, which can be configured to monitor a physical state or change of physical state of the crown (e.g., the position and/or rotational state of the crown), convert it to an electrical signal (e.g., convert it to an analog or digital signal representation of the position or change in position of the crown), and provide the signal to processor 202. For instance, in some examples, encoder 204 can be configured to sense the absolute rotational position (e.g., an angle between 0-360°) of crown 208 and output an analog or digital representation of this position to processor 202. Alternatively, in other examples, encoder 204 can be configured to sense a change in rotational position (e.g., a change in rotational angle) of crown 208 over some sampling period and to output an analog or digital representation of the sensed change to processor 202. In these examples, the crown position information can further indicate a direction of rotation of the crown 208 (e.g., a positive value can correspond to one direction and a negative value can correspond to the other). In yet other examples, encoder 204 can be configured to detect a rotation of crown 208 in any desired manner (e.g., velocity, acceleration, or the like) and can provide the crown rotational information to processor 202. The rotational velocity can be expressed in numerous ways. For example, the rotational velocity can be expressed as a direction and a speed of rotation, such as hertz, as rotations per unit of time, as rotations per frame, as revolutions per unit of time, as revolutions per frame, as a change in angle per unit of time, and the like. In alternative examples, instead of providing information to processor 202, this information can be provided to other components of device 200, such as, for example, a state machine.

In some examples, the state of the display 206 (which can correspond to display 106 described above) can control physical attributes of crown 208. For example, if display 206 shows a cursor at the end of a scrollable list, crown 208 can have limited motion (e.g., cannot be rotated forward). In other words, the physical attributes of the crown 208 can be conformed to a state of a user interface that is displayed on display 206. In some examples, a temporal attribute of the physical state of crown 208 can be used as an input to device 200. For example, a fast change in physical state can be interpreted differently than a slow change in physical state. These temporal attributes can also be used as inputs to control physical attributes of the crown.

Processor 202 can be further coupled to receive input signals from buttons 210, 212, and 214 (which can correspond to buttons 110, 112, and 114, respectively), along with touch signals from touch-sensitive display 206. Processor 202 can be configured to interpret these input signals and output appropriate display signals to cause an image to be produced by touch-sensitive display 206. While a single processor 202 is shown, it should be appreciated that any number of processors or other computational devices can be used to perform the functions described above.

Figure 3:
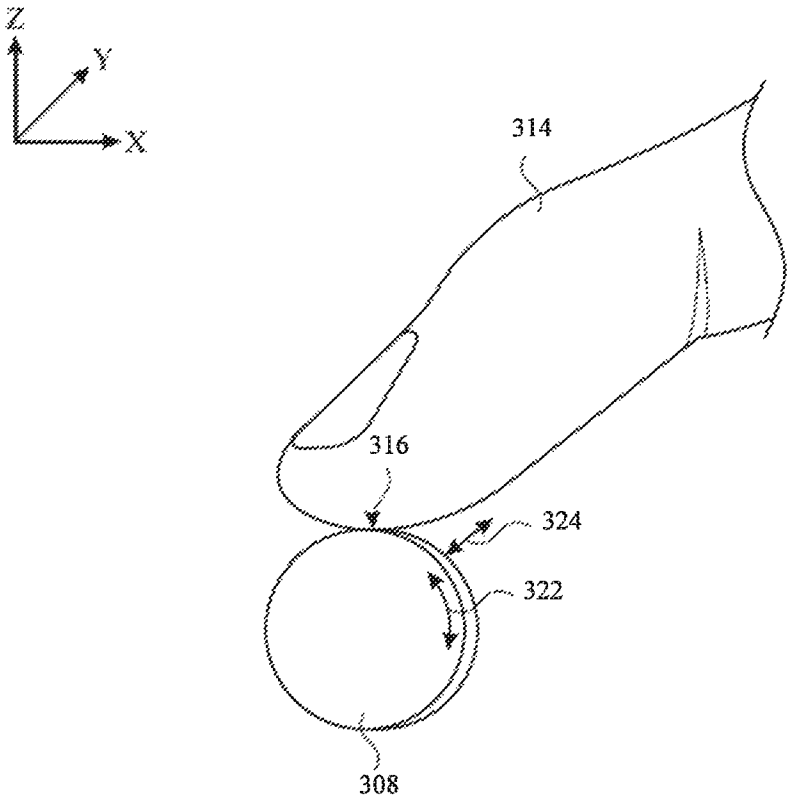
FIG. 3 illustrates an exemplary finger interacting with a protruding rotary input according to examples of the disclosure.

FIG. 3 illustrates an exemplary finger 314 interacting with a protruding rotary input 308 according to examples of the disclosure. FIG. 3 depicts an exemplary rotary input 308 (which can correspond to crown 108 and/or a rotating bezel above) that can rotate in rotational direction 322 as well as be displaced in direction 324, i.e. translated along the direction of the rotation axis toward and/or away from a device (e.g., device 100 above), according to examples of the disclosure. Finger 314 can be resting on rotary input 308, and can be providing rotational input to the rotary input in rotational direction 322.

Examples of the disclosure are directed to configurations of an encoder, such as encoder 204 described above with respect to FIG. 2, that utilize magnetic sensing to detect rotation of a crown, such as crown 208. Compared with conventional encoder technologies, such as optical sensing, magnetic sensing can offer reduced power usage; high dynamic range; linear response; resistance to environmental noise; and a compact physical footprint. These advantages may be particularly desirable for crowns that integrate with wearable devices, such as device 100 above, which must offer reliable operation in a variety of unpredictable physical environments, and typically are powered by batteries of limited capacity. In addition, magnetic sensing technologies may be particularly well-suited to identify an absolute position (rather than a relative position) of a crown. The ability to identify an absolute position may be especially useful for situations in which no reference position (from which to calculate a relative position) is available, or in which a reference position may drift over time; wearable devices, which may be frequently cycled on and off, may frequently present such situations.

Figure 4A:
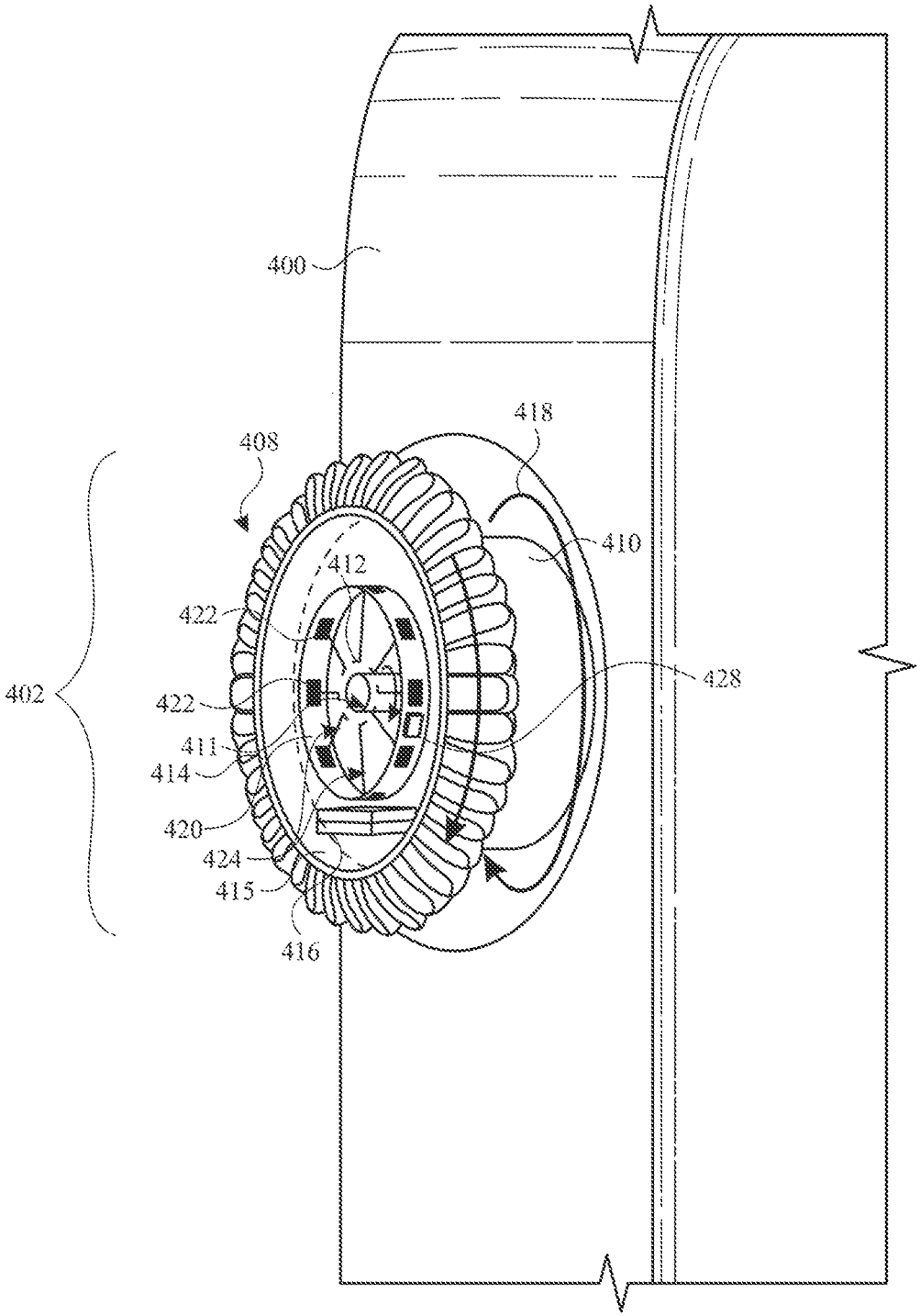
FIGS. 4A-4C illustrate an exemplary configuration for detecting rotational movement of a crown via magnetic sensing according to examples of the disclosure.
Figure 4B:
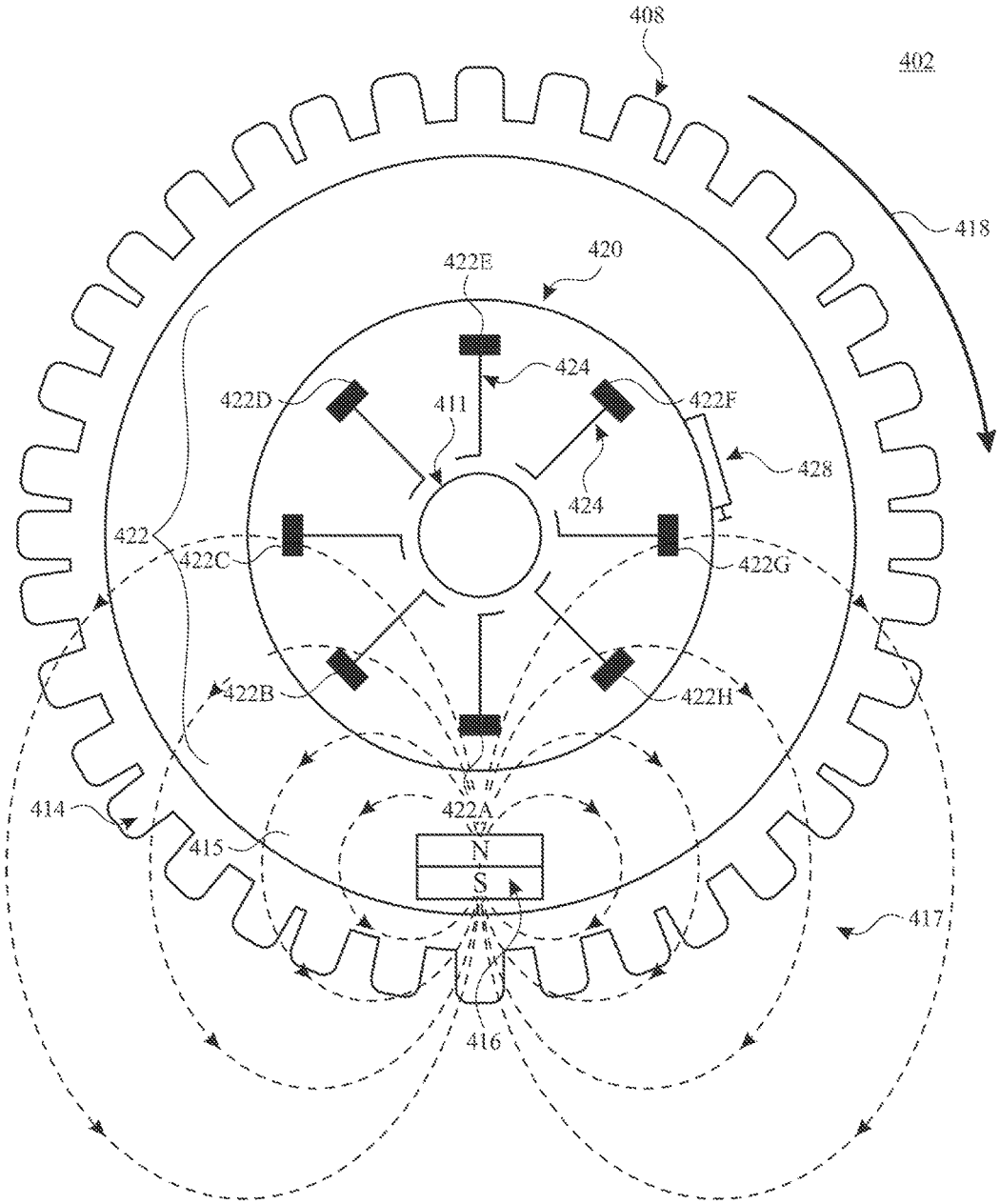
Figure 4C:
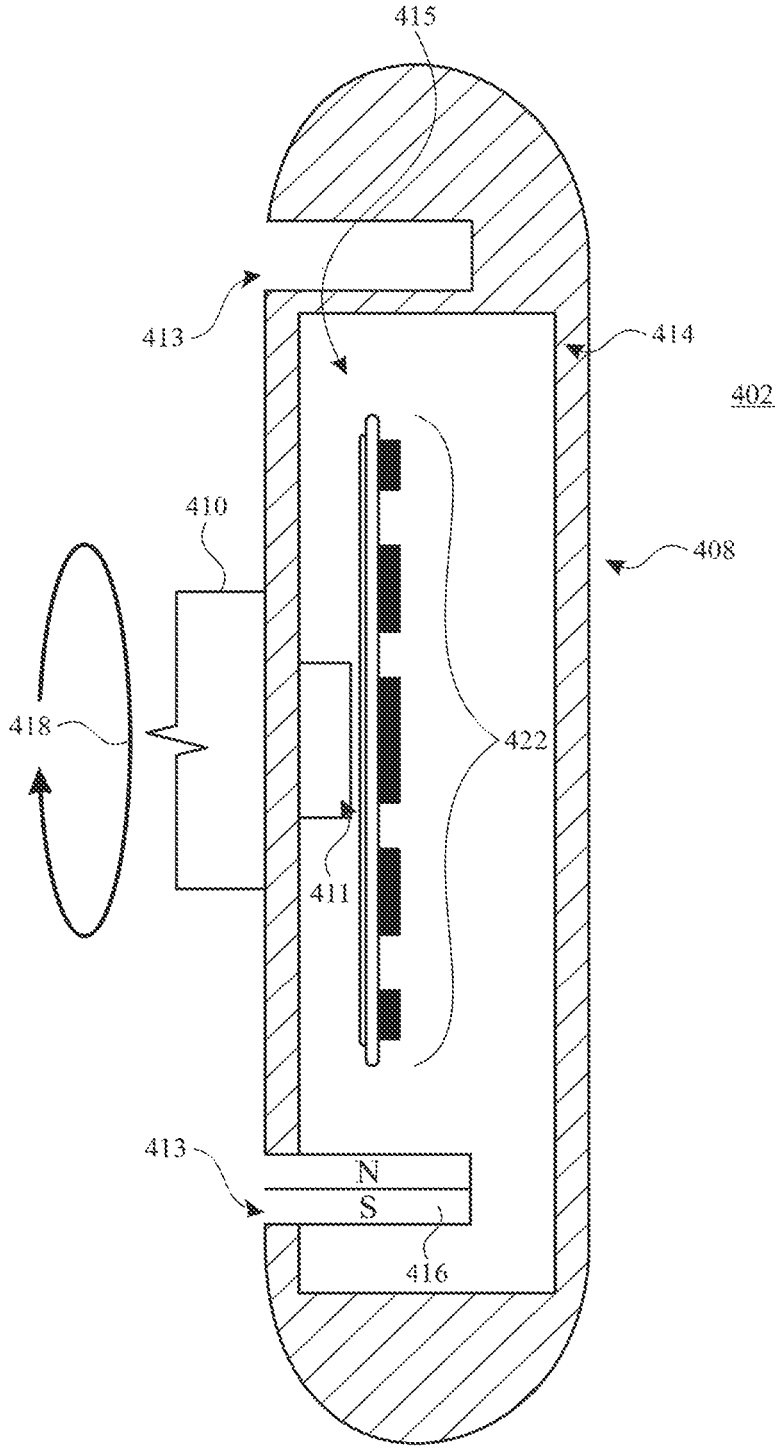

FIGS. 4A-4C illustrate an exemplary configuration for detecting rotational movement of a crown via magnetic sensing according to examples of the disclosure. FIG. 4A depicts a perspective view of a crown 402 (which can correspond to crown 108 above) coupled to an enclosure of a personal electronic device 400 (which can correspond to device 100 above) via shaft 410. Device 400 may include or interface to a processor, such as processor 202 described above with respect to FIG. 1, which can input and output electronic signals. FIG. 4B depicts a front view of the crown, and FIG. 4C depicts a cutaway side view of the crown. In the example shown, crown 402 comprises a ring-shaped (or cylindrical) housing 414 comprising a hollow cavity 415 and an outer ring 408 (which can correspond to protruding rotary input 308 above), through which a user interacts with housing 414. Housing 414 may rotate in rotational direction 418 (relative to device 400) in response to rotational input provided to outer ring 408 by a user's finger (e.g., finger 314 described above with respect to FIG. 3). In some examples, such as shown in FIGS. 4A and 4B, outer ring 408 may feature a grooved or textured surface to facilitate such input. In some examples, housing 414 may be mechanically coupled to shaft 410, such that shaft 410 rotates in rotational direction 418 as housing 414 rotates in rotational direction 418. In the example shown, shaft 410 is concentric with crown 402. In some examples, housing 414 may be configured to provide electromagnetic shielding to components in the hollow cavity 415. For example, housing 414 may be constructed of conductive or magnetic material, or may be coated with such material.

In the example shown in FIGS. 4A-4C, crown 402 further includes a circular member 420, disposed in the hollow cavity 415 of housing 414 and concentric with crown 402 and shaft 410, that rotates in rotational direction 418 as housing 414 rotates in rotational direction 418. In some examples, circular member 420 may be a flexible circuit board (i.e., a flexible structure that can carry electronic signals via conductive traces) disposed in a circular shape. In the example shown, one or more magnetic sensing cells 422 are mounted on circular member 420, such that magnetic sensing cells 422 rotate with circular member 420 as circular member 420 rotates. In the example shown in FIGS. 4A-4C, magnetic sensing cells 422 include eight individual magnetic sensing cells 422A-422H. However, the disclosure is not limited to any particular number of magnetic sensing cells. Some examples, for instance, may feature 128 such cells, or 256 such cells. As described in more detail below, each of magnetic sensing cells 422 may comprise a magnetically sensitive element, such as a magnetoresistor that exhibits an electrical resistance that varies in relation to a magnetic field. In examples in which housing 414 is configured to provide electromagnetic shielding, such shielding can improve the performance of magnetic sensing cells 422 by reducing stray electromagnetic interference. In some examples, such as in FIGS. 4A-4C, magnetic sensing cells 422 may be evenly spaced around the circumference of circular member 420.

In the example shown in FIGS. 4A-4C, an integrated circuit 428 may be mounted to circular member 420 and electronically coupled to one or more of magnetic sensing cells 422. Integrated circuit 428 may include any components, or exhibit any functionality, that may be associated with an integrated circuit. For example, integrated circuit 428 may include a processor (not shown); may accept input signals and present output signals; may include or interface to a memory (not shown); and may electronically interface with magnetic sensing cells 422 via conductive traces on circular member 420 (e.g., in examples in which circular member 420 is a flexible circuit board). By mounting integrated circuit 428 to circular member 420, and processing signals from magnetic sensing cells 422 (which may also be mounted to circular member 420) directly in integrated circuit 428, rather than on host processor 202, the challenge of electronically coupling magnetic sensing cells 422 to a processor may be simplified. For example, as circular member 420 rotates, as described below, magnetic sensing cells 422 may rotate with respect to host device 400, which may tangle or strain physical connections (e.g., wires) that may exist between the cells and the host device, and which may degrade direct electrical connections that may exist between the cells and the host device (e.g., via friction caused by the rotating member). These problems can be reduced or eliminated by mounting both the processor (e.g., in integrated circuit 428) and the magnetic sensing cells 422 to the same rotating member, such that the processor and the cells are fixed relative to one another.

In some examples, one or more of magnetic sensing cells 422 and integrated circuit 428 may be configured to electronically couple to host processor 202 of device 400 via head 411 of shaft 410, for example via conductive leads 424. Further, in some examples, shaft 410 may electronically connect to device 400 via a B2B (board-to-board) connector (not shown), and may communicate via any of a number of interface protocols (e.g., I2C, SPI). In some examples, wireless communications (e.g., Bluetooth) may be used to connect one or more of magnetic sensing cells 422 and integrated circuit 428 to host processor 202. In some examples, one or more of magnetic sensing cells 422 and integrated circuit 428 may be configured to receive a supply voltage from host device 400 via a bus, such as a bus disposed inside shaft 410.

The example shown in FIGS. 4A-4C includes a magnet 416, which remains stationary relative to device 400 in response to rotational input applied to housing 414. That is, while housing 414 and circular member 420 rotate in rotational direction 418, magnet 416 does not rotate. In some examples, magnet 416 may be mounted to device 400, and disposed at least partially in the hollow cavity 415 of housing 414, such that magnet 416 does not rotate with outer ring 408 and circular member 420. In some examples, magnet 416 may be configured to extend into the cavity 415 via a groove 413 (e.g., a circular groove) in housing 414, such that housing 414 may rotate freely around magnet 416 while magnet 416 remains stationary with respect to device 400. In some examples, magnet 416 may be mounted to a plate inside cavity 415, to a collar of shaft 410 or head 411, or to another structure wholly or partially inside cavity 415 and configured to remain stationary with respect to device 400 while housing 414 rotates, even though magnet 416 may not be directly mounted to device 400. Magnet 416 may be any device exhibiting a magnetic field, such as magnetic field 417 shown in FIG. 4B (not shown in FIG. 4A and FIG. 4C). In the example shown, magnet 416 may be a permanent magnet exhibiting a fixed magnetic field. In other examples, magnet 416 may be an electromagnet exhibiting a magnetic field that varies with the current flowing through magnet 416. In such examples, magnet 416 may be configured to receive a supply voltage from host device 400 via a bus, such as a bus disposed inside shaft 410. Further, in some examples, magnet 416 may comprise two or more physically separate magnets; the examples of the disclosure are not limited to any particular type or number of such magnets.

In some examples, magnet 416 may be disposed wholly or partially inside host device 400, rather than in the cavity 415 of the housing 414. Such examples may be mechanically simpler than the example configuration shown in FIGS. 4A-4C, for example because the magnet may not need to remain stationary inside of a rotating housing. In some examples in which magnet 416 is disposed inside host device 400, electromagnetic shielding may be provided by a conductive or magnetic material mounted to device 400, or by a housing of device 400 itself. In some examples, such as where device 400 is commonly used in electromagnetically isolated environments, electromagnetic shielding may not be necessary at all. In some examples, however, the ability to provide electromagnetic shielding for magnet 416 may be limited where such shielding may interfere with magnetically sensitive components of device 400, such as compasses or accelerometers. In such examples, electromagnetic shielding may be configured such that it shields magnet 416 and/or crown 402, but does not shield other components of device 400.

Figure 5:
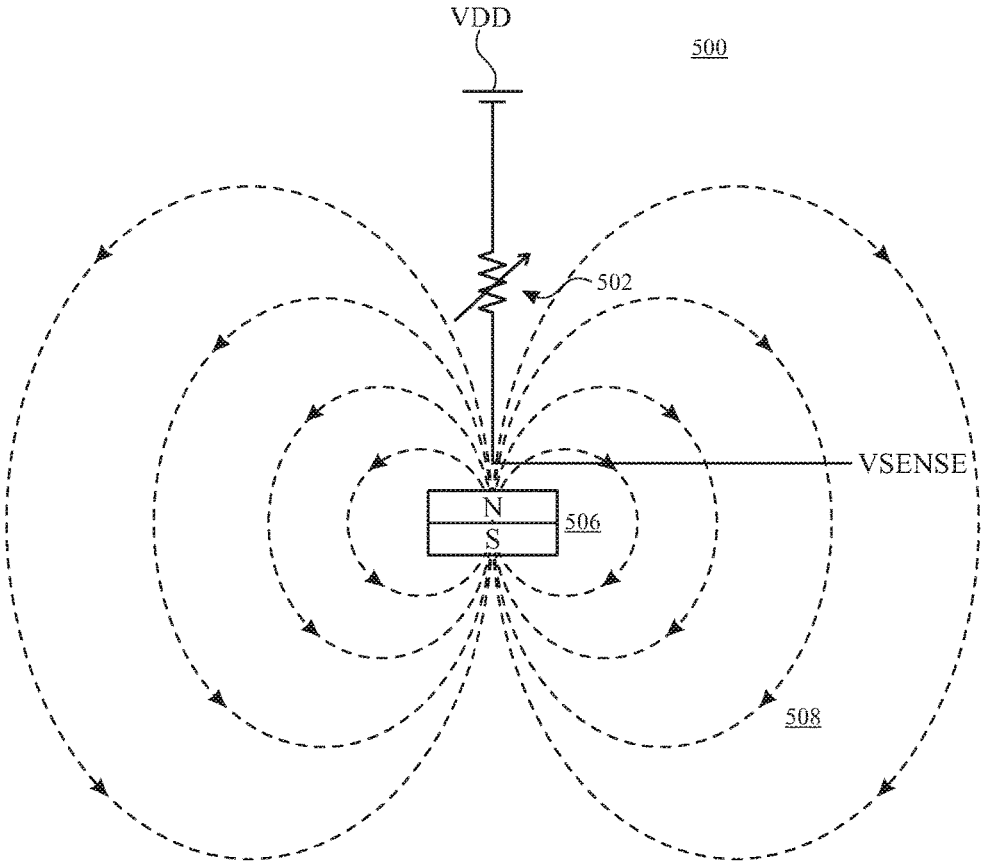
FIG. 5 illustrates an exemplary electronic circuit in an exemplary magnetic sensing cell according to examples of the disclosure.

FIG. 5 illustrates an example electronic circuit 500 in an example magnetic sensing cell (e.g., one of magnetic sensing cells 422) according to examples of the disclosure. FIG. 5 depicts a magnetoresistor 502—that is, a resistor whose resistance Rsense changes with the flux of a magnetic field at the location of the resistor—in a configuration with a source voltage Vdd at one terminal and an output voltage Vsense at the other terminal. In FIG. 5, example magnet 506 (which may correspond to magnet 416 described above) corresponds to a magnetic field represented in FIG. 5 by magnetic field lines 508. As described above, magnet 506 may be a permanent magnet or an electromagnet. As the strength of the magnetic field 508 through the magnetoresistor 502 increases—for example, as magnetoresistor 502 moves closer to magnet 506, such that magnetoresistor 502 intersects a stronger portion of magnetic field 508 (whose strength falls off with the distance from magnet 506)—Rsense decreases, such that output signal Vsense may increase (e.g., if resistor 502 is placed in a voltage divider configuration) and approach the value of supply voltage Vdd. Conversely, as the strength of the magnetic field 508 through the magnetoresistor 502 decreases—for example, as magnetoresistor 502 moves farther from magnet 506, such that magnetoresistor 502 intersects a weaker portion of magnetic field 508 (whose strength falls off with the distance from magnet 506)—Rsense increases, such that output signal Vsense may decrease (e.g., if resistor 502 is placed in series with a second resistor in a voltage divider configuration), or may enter a high-impedance state, with respect to Vdd. In this way, magnetoresistor 502 can be used to generate an electrical signal corresponding to a strength of a magnetic field at its location. Further, in some examples, magnetoresistor 502 and/or circuit 500 may be configured to respond to a direction (not merely a magnitude) of magnetic field 508, such that Vsense may reflect a strength and/or a direction of the magnetic field at the location of magnetoresistor 502.

Figure 6:
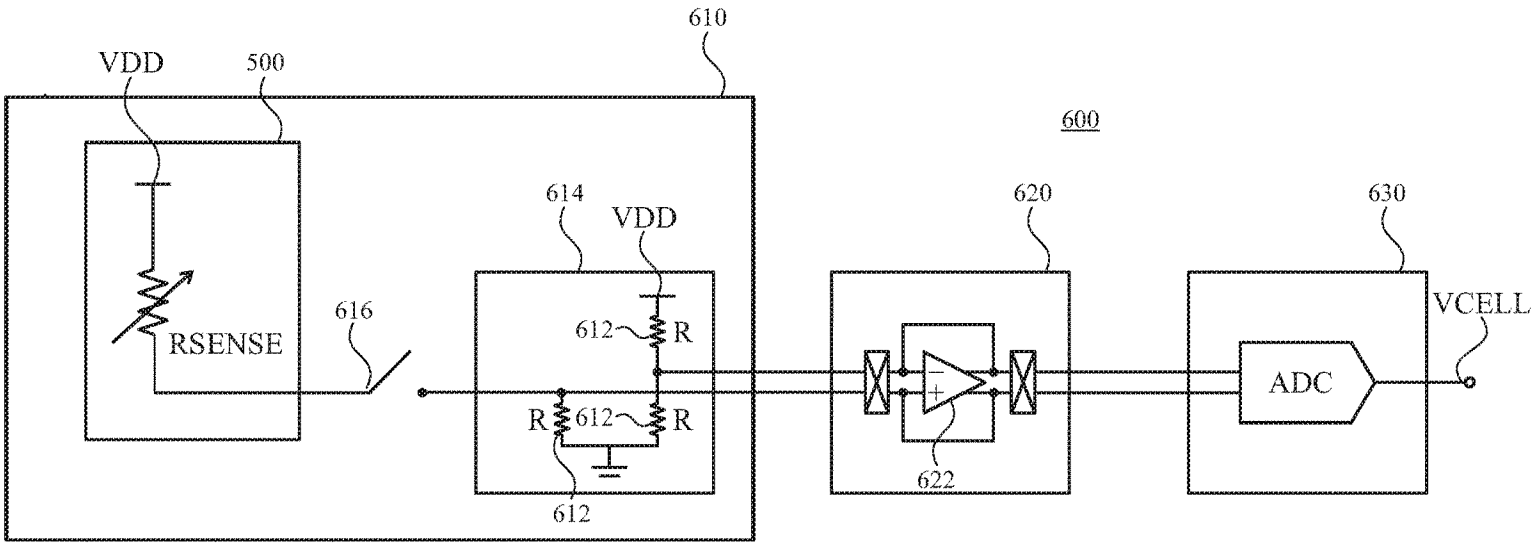
FIG. 6 illustrates an exemplary electronic circuit for generating a digital signal corresponding to the output of a magnetic sensing cell according to examples of the disclosure.

FIG. 6 illustrates an example electronic circuit 600 for generating a digital signal corresponding to the output of a magnetic sensing cell according to examples of the disclosure. Stage 610 comprises circuit 500 (which may be associated with one of magnetic sensing cells 422, as described above) in a Wheatstone bridge configuration with three fixed-value resistors 612 as shown in FIG. 6. In some examples, circuit 500 may comprise a selected one of magnetic sensing cells 422 (e.g., a cell selected by switch 616, which may be any appropriate switching mechanism, such as a multiplexer), while the remainder of the Wheatstone bridge circuitry (614) in stage 610 may be in integrated circuit 428. As described above, circuit 500 comprises a magnetoresistor 502 (exhibiting a variable resistance Rsense) connected to a supply voltage Vdd and an output voltage Vsense. In the example Wheatstone bridge configuration shown in FIG. 6, stage 610 outputs a pair of voltage signals V1 and V2 such that the difference (i.e., V1−V2) corresponds to the value Rsense of magnetoresistor 502. At stage 620 of FIG. 6 in the example shown, differential voltage signals V1 and V2 may enter a filtering stage, for example in which noise is removed from the signal V1−V2. In the example shown, stage 620 comprises an optional chopper-stabilized amplifier 622 to remove low frequency noise from the differential signal V1−V2. In some examples, integrated circuit 428 may include the circuitry of stage 620 and may perform the filtering described. Other examples of filtering the differential signal V1−V2 will be apparent; the disclosure is not limited to any particular example of filtering the signal, and in some examples, the signal may not be filtered at all. At stage 630 in the example, differential signals V1 and V2 then enter an analog-to-digital converter circuit to output a digital signal Vcell, corresponding to the value Rsense of magnetoresistor 502. In some examples, integrated circuit 428 may include the circuitry of stage 630 and may perform the analog-to-digital conversion described. Vcell may be provided as input to a processor (e.g., host processor 202, or a processor included in integrated circuit 428) which, as described below, may process one or more values of Vcell to determine a rotational position of crown 402.

In some examples, circuit 600 may be coupled to only a single circuit (e.g., circuit 500 shown in FIG. 5) associated with a single magnetic sensing cell 422. In other examples, circuit 600 may be selectively coupled to one or more circuits (e.g., circuit 500) of a plurality of circuits associated with magnetic sensing cells 422. For instance, a switching mechanism 616 may couple circuit 500 to Wheatstone bridge circuitry 614, or to another aspect of circuit 600. Any suitable switching mechanism 616 may be used. In some examples, switching mechanism 616 may belong to a multiplexer, for example, a multiplexer of integrated circuit 428; a multiplexer of processor 202; or a discrete multiplexer mounted to rotating member 420. By using a switching mechanism to selectively couple a subset of magnetic sensing cells 422 to circuit 600 (for instance, by serially cycling through a set of control signals, each corresponding to one or more cells), circuit 600 may be shared among two or more magnetic sensing cells 422—limiting the need for duplicate or redundant circuitry, and minimizing the power consumption and physical space requirements of circuit 600. However, in some examples in which speed or throughput are paramount, circuit 600 may limit or forgo such a switching mechanism, and process magnetic sensing cells 422 in parallel.

Figure 7A:
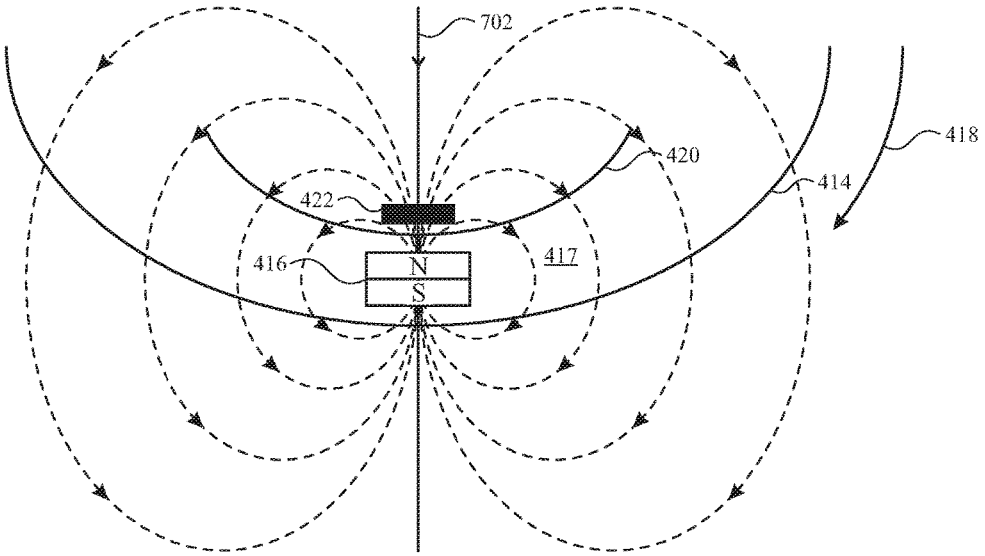
FIGS. 7A-7B illustrate an example of computing a rotational position of a crown using a magnetic sensing cell according to examples of the disclosure.
Figure 7B:
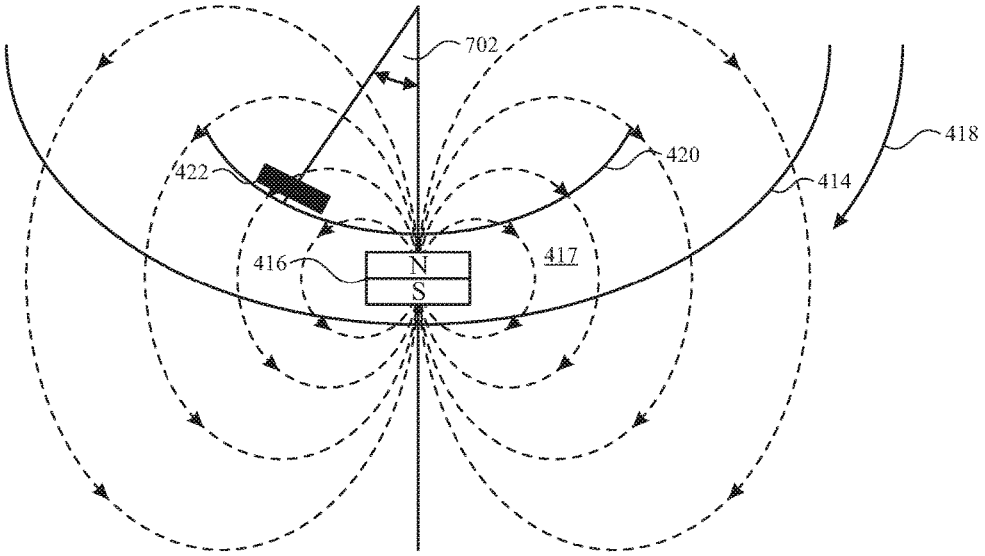

FIGS. 7A-7B illustrate an example of computing a rotational position of crown 402 using a magnetic sensing cell, according to examples of the disclosure. FIGS. 7A-7B depict example magnetic sensing cell 422A (which may correspond to one of magnetic sensing cells 422 described above) mounted on circular member 420 such that magnetic sensing cell 422A rotates in rotational direction 418 (relative to device 400) as circular member 420 rotates in rotational direction 418, along with housing 414 of crown 402, as described above. The rotational position of the cell and the crown is represented in the figures by angle 702. In the figures, circular member 420 is disposed above magnet 416 which exhibits a magnetic field 417 (which, in this example, is a fixed magnetic field). In FIG. 7A, circular member 420 is rotationally positioned such that magnetic sensing cell 422A is at a first position P1, in which angle 702 is zero degrees with respect to the vertical, which corresponds to the bottom of circular member 420. At this rotational position, magnetic sensing cell 422A is at its closest position to magnet 416. When magnetic sensing cell 422A is at position P1, magnetic sensing cell 422A experiences a first magnetic field strength T1, corresponding to the strength at position P1 of the field generated by magnet 416. Magnetic sensing cell 422A may thus generate an output signal (e.g., Vsense in electronic circuit 500) corresponding to T1. In FIG. 7B, circular member 420 has rotated with respect to its position in FIG. 7A, such that magnetic sensing cell 422A is rotationally positioned at a second position P2, at which angle 702 is at some angle greater than zero. When magnetic sensing cell 422A is at position P2, magnetic sensing cell 422A experiences a second magnetic field strength T2, corresponding to the strength at position P2 of the field generated by magnet 416. Because magnetic sensing cell 422A is farther from magnet 416 at position P2 than at position P1, the field strength T2 experienced by the cell is lower than field strength T1; accordingly, in some examples, an output signal (e.g., Vsense in electronic circuit 500) may be higher or lower at position P2 than at position P1. In examples where magnetic sensing cell 422A comprises the example electronic circuit 500 shown in FIG. 5, Vsense will be lower at position P2 than position P1 to reflect the lower value of T2 compared to T1.

In the example described above with respect to FIGS. 7A-7B, magnetic sensing cell 422A rotates with circular member 420 (with respect to magnet 416) and generates an output signal (e.g., Vsense in electronic circuit 500) that corresponds to the angular rotational position 702 of magnetic sensing cell 422A. Because magnetic sensing cell 422A is fixed relative to circular member 420 in this example, the rotational position of circular member 420 (and thus crown 402, which rotates with circular member 420) can be determined from the output signal. In some examples, this determination may be performed by host processor 202; in some examples, it may be performed by a processor included in integrated circuit 428.

Figure 8A:
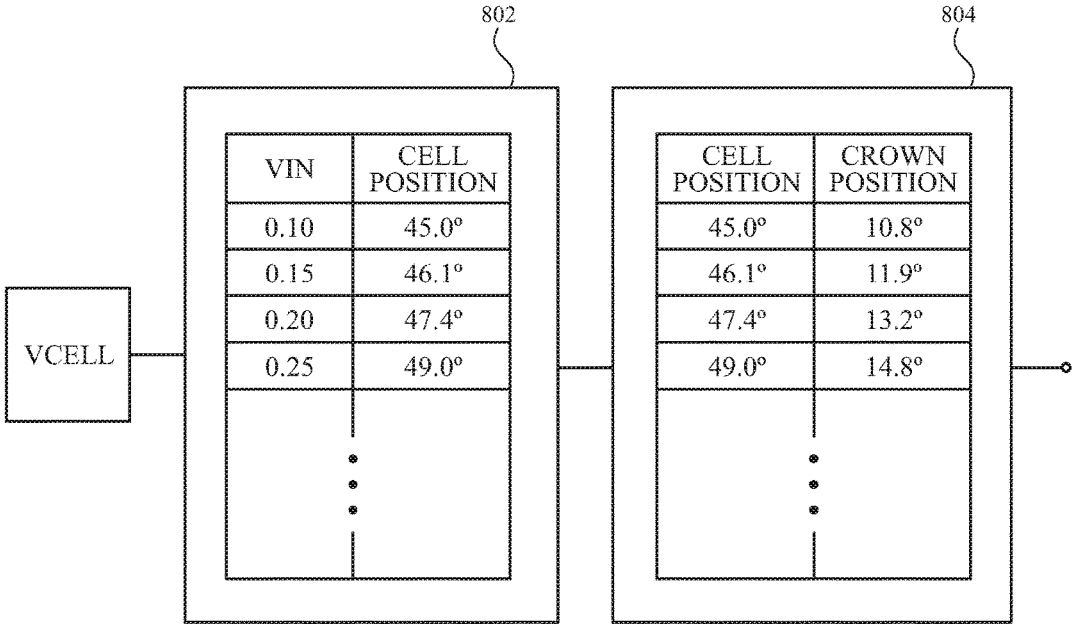
FIGS. 8A and 8B illustrate examples of calculating a rotational position of a crown from an output signal of a magnetic sensing cell according to examples of the disclosure.
Figure 8B:
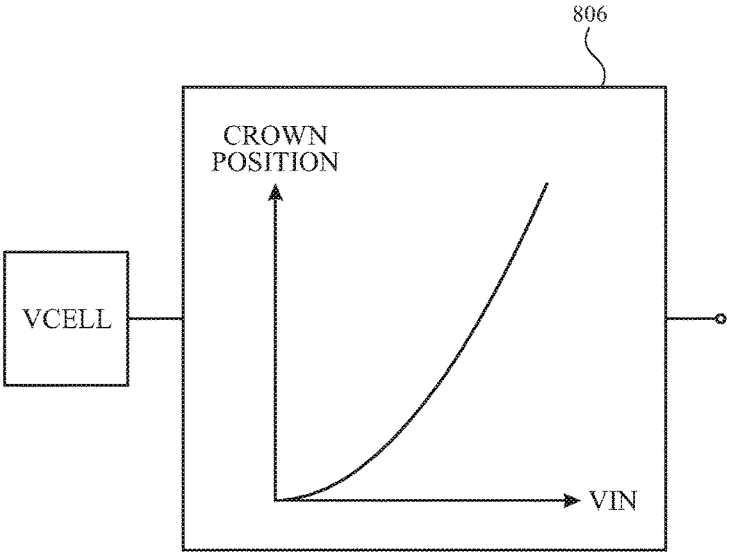

FIGS. 8A-8B depict examples of calculating a rotational position of a crown from an output signal of a magnetic sensing cell, according to examples of the disclosure. The calculations depicted in the examples could be implemented in a processor (e.g., processor 202, or a processor included in integrated circuit 428 attached to circular member 420) that accepts as input the output of a magnetic sensing cell (e.g., the signal Vcell described above with respect to FIG. 6). In the example shown in FIG. 8A, the processor can communicate with a memory that includes a first table 802 comprising a mapping of input signal (e.g., Vcell) values to rotational positions of magnetic sensor cells (e.g., magnetic sensor cell 422A), and a second table 804 comprising a mapping of rotational positions of magnetic sensor cell 422A to the rotational position of crown 402. The processor can look up the nearest value of Vcell in table 802 to determine a rotational position of magnetic sensor cell 422A, and then look up the nearest rotational position of magnetic sensor cell 422A in table 804 to determine a rotational position of crown 402. In another example, shown in FIG. 8B, the processor may be configured to apply a function 806 to directly convert an input signal (e.g., Vcell) to a rotational position of crown 402. Other techniques for determining the rotational position of crown 402 from Vcell will be apparent, and the disclosure is not limited to any particular technique.

In the above example described, which utilizes only a single magnetic sensing cell 422A, the ability to determine the rotational position of crown 402 may be limited by the ability (e.g., the ability of a processor and/or memory) to correlate an output signal of the magnetic sensing cell to a rotational position of that cell. This ability may be limited in configurations where, for example, magnetic sensing cell 422A does not exhibit a unique output signal for each rotational position of the cell (e.g., where magnet 416 is not sufficiently strong to interact with the magnetic sensing cell at rotational positions farthest from the magnet); where the relationship between the cell output and some rotational positions (e.g., rotational positions farthest from the magnet) is rendered unreliable by electromagnetic interference; or where the signal-to-noise ratio of the magnetic sensing cell output is too low for the cell output to be reliably measured. Further, utilizing only a single magnetic sensing cell may limit the dynamic range of the sensor beyond what is desirable for some applications, or may result in insufficiently linear response. These problems can be addressed by utilizing an array of multiple magnetic sensing cells (e.g., cells 422A-422H in FIG. 4A), computing a plurality of rotational positions corresponding to the multiple cells, and using the plurality of rotational positions to determine the rotational position of crown 402.

Figure 9:
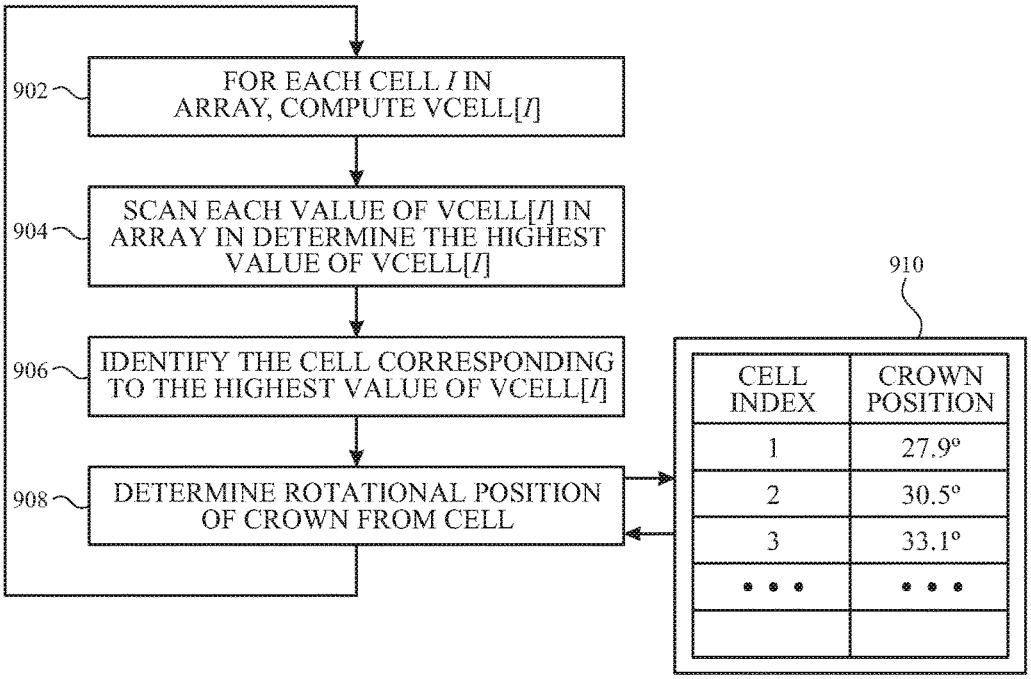
FIG. 9 illustrates an example of determining a rotational position of a crown using a plurality of magnetic sensor cells according to examples of the disclosure.

FIG. 9 depicts an example of determining a rotational position of a crown using a plurality of magnetic sensing cells, according to examples of the disclosure. In some examples, this determination may be performed by host processor 202; in some examples, the determination may be performed by a processor of integrated circuit 428. In the example shown in FIG. 9, each of an array 422 of magnetic sensing cells 422A-422H is associated with an index value i, and Vcell[i] represents an output signal Vcell corresponding to the cell associated with index i. Various ways of associating a magnetic sensing cell with an index value will be apparent. For example, the output signals (e.g., Vsense) of an array of magnetic sensing cells may be connected to the inputs of an analog multiplexer, with a processor supplying a binary value corresponding to index i as one or more control signals to the multiplexer. For instance, a value corresponding to index i could be provided to a decoder, such that the decoder outputs a corresponding address signal to the multiplexer.

At stage 902, a value of Vcell[i] can be determined, for example as described above with respect to FIG. 6, for each cell in the array 422. In some examples, this determination may be performed by host processor 202; in some examples, the determination may be performed by a processor of integrated circuit 428. Values of Vcell[i] can be provided to a processor (e.g., processor 202, or a processor included in integrated circuit 428 attached to circular member 420) as described above. At stage 904, the processor can scan (e.g., using a multiplexer) through all values of Vcell[i] corresponding to the cells in array 422. At stage 906, the processor can identify, based on the values of Vcell[i], which of the cells in array 422 is closest to magnet 416 (e.g., in the example shown in FIG. 9, by determining which value of Vcell is the highest and therefore corresponds to the strongest magnetic field through that cell). By knowing the rotational position of each of the cells in array 422 with respect to the crown 402, the processor can thus determine, at stage 908, the rotational position of crown 402 based on which cell is closest to magnet 416. For example, the processor might identify the cell with index 3 as closest to magnet 416, and thus near the bottom rotational position of crown 402. In the example, the processor can use a lookup table 910, identifying the rotational position of each cell with respect to the rotational position of the crown, to determine that since cell 422B is at the bottom rotational position of crown 402, crown 402 must be oriented at 30.5 degrees relative to some base position. The accuracy of the example may be increased by increasing the number of magnetic sensing cells in array 422. Furthermore, because each Vsense signal from a corresponding sensor can be physically connected to a specific multiplexer input, the corresponding position of crown 402 associated with each index i can provide an absolute rotational position of the crown.

Figure 10:
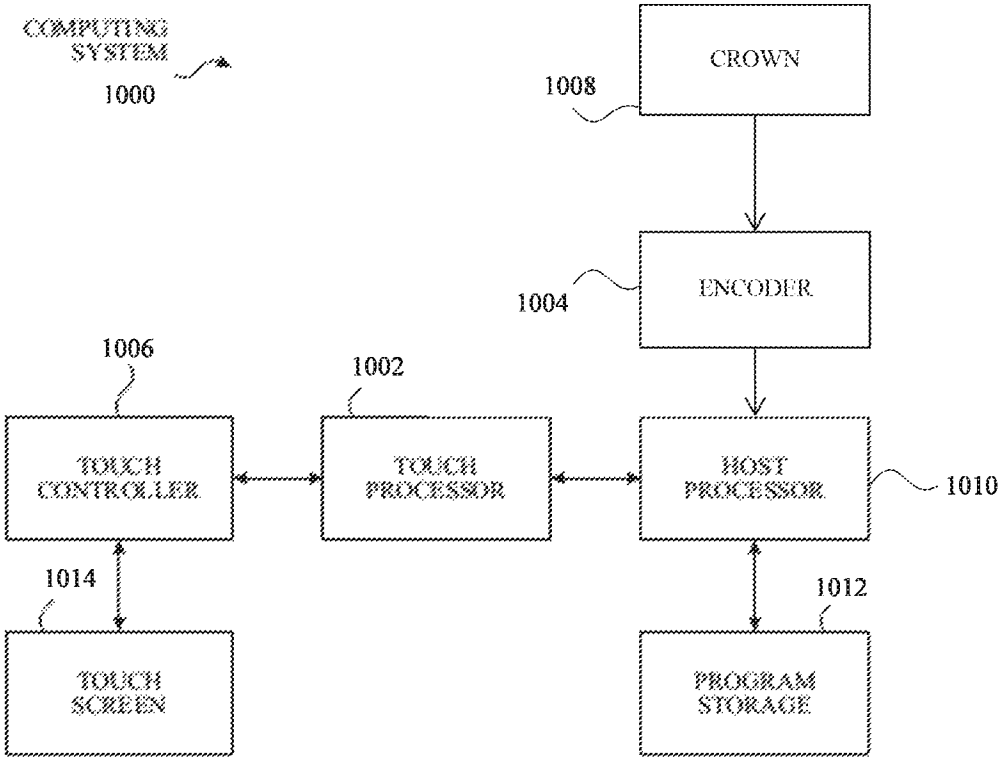
FIG. 10 illustrates an example computing system for implementing rotational input sensing according to examples of the disclosure.

FIG. 10 illustrates an example computing system 1000 for implementing rotational input sensing according to examples of the disclosure. Computing system 1000 can be included in, for example, electronic device 100 or any mobile or non-mobile computing device and/or wearable device that includes a crown 1008 (which can correspond to crown 108 above). Computing system 1000 can include a touch sensing system including one or more touch processors 1002, touch controller 1006 and touch screen 1014. Touch screen 1014 can be a touch screen adapted to sense touch inputs, as described in this disclosure. Touch controller 1006 can include circuitry and/or logic configured to sense touch inputs on touch screen 1014. In some examples, touch controller 1006 and touch processor 1002 can be integrated into a single application specific integrated circuit (ASIC).

Computing system 1000 can also include host processor 1010 for receiving outputs from touch processor 1002 and performing actions based on the outputs. Host processor 1010 can be connected to program storage 1012. For example, host processor 1010 can contribute to generating an image on touch screen 1014 (e.g., by controlling a display controller to display an image of a user interface (UI) on the touch screen), and can use touch processor 1002 and touch controller 1006 to detect one or more touches on or near touch screen 1014. Host processor 1010 can also contribute to sensing and/or processing mechanical inputs (e.g., rotation, tilting, displacement, etc.) from a crown 1008 (which can be a type of mechanical input mechanism) that can be detected by an encoder 1004 (which can correspond to encoder 204 above). The touch inputs from touch screen 1014 and/or mechanical inputs from the crown 1008 can be used by computer programs stored in program storage 1012 to perform actions in response to the touch and/or mechanical inputs. For example, touch inputs can be used by computer programs stored in program storage 1012 to perform actions that can include moving an object such as a cursor or pointer, scrolling or panning, adjusting control settings, opening a file or document, viewing a menu, making a selection, executing instructions, operating a peripheral device connected to the host device, answering a telephone call, placing a telephone call, and other actions that can be performed in response to touch inputs. Mechanical inputs from a mechanical input mechanism can be used by computer programs stored in program storage 1012 to perform actions that can include changing a volume level, locking the touch screen, turning on the touch screen, taking a picture, navigating through three-dimensional menus and environments, and other actions that can be performed in response to mechanical inputs. Host processor 1010 can also perform additional functions that may not be related to touch and/or mechanical input processing.

Note that one or more of the functions described above can be performed by firmware stored in memory in computing system 1000 and executed by touch processor 1002, or stored in program storage 1012 and executed by host processor 1010. The firmware can also be stored and/or transported within any non-transitory computer-readable storage medium for use by or in connection with an instruction execution system, apparatus, or device, such as a computer-based system, processor-containing system, or other system that can fetch the instructions from the instruction execution system, apparatus, or device and execute the instructions. In the context of this document, a "non-transitory computer-readable storage medium" can be any medium (excluding signals) that can contain or store the program for use by or in connection with the instruction execution system, apparatus, or device. The computer-readable storage medium can include, but is not limited to, an electronic, magnetic, optical, electromagnetic, infrared, or semiconductor system, apparatus or device, a portable computer diskette (magnetic), a random access memory (RAM) (magnetic), a read-only memory (ROM) (magnetic), an erasable programmable read-only memory (EPROM) (magnetic), a portable optical disc such a CD, CD-R, CD-RW, DVD, DVD-R, or DVD-RW, or flash memory such as compact flash cards, secured digital cards, USB memory devices, memory sticks, and the like.

The firmware can also be propagated within any transport medium for use by or in connection with an instruction execution system, apparatus, or device, such as a computer-based system, processor-containing system, or other system that can fetch the instructions from the instruction execution system, apparatus, or device and execute the instructions. In the context of this document, a "transport medium" can be any medium that can communicate, propagate or transport the program for use by or in connection with the instruction execution system, apparatus, or device. The transport medium can include, but is not limited to, an electronic, magnetic, optical, electromagnetic or infrared wired or wireless propagation medium.

Therefore, according to the above, some examples of the disclosure are directed to an electronic device configured to be worn by a user comprising: a crown operatively coupled to a body of the electronic device and configured to rotate in a first direction with respect to the body of the electronic device in response to a mechanical input provided by the user, the crown comprising a housing; a rotating member disposed at least partially inside the housing and configured to rotate in the first direction in response to the mechanical input; a first magnetic sensing cell attached to the rotating member at a first location of the rotating member and electrically connected to a first electronic circuit; and a magnet configured to remain stationary with respect to the body of the electronic device; wherein the first electronic circuit is configured to generate a first signal corresponding to a rotational position of the crown with respect to the body of the electronic device. Additionally or alternatively to one or more of the examples disclosed above, in some examples, the first magnetic sensing cell is configured to provide to the first electronic circuit a signal corresponding to a strength, at a position of the first magnetic sensing cell, of a magnetic field corresponding to the magnet. Additionally or alternatively to one or more of the examples disclosed above, in some examples, the first electronic circuit is attached to the rotating member and configured to rotate in the first direction in response to the mechanical input. Additionally or alternatively to one or more of the examples disclosed above, in some examples, the magnet is disposed at least partially inside the body of the electronic device. Additionally or alternatively to one or more of the examples disclosed above, in some examples, the magnet is disposed at least partially inside the housing. Additionally or alternatively to one or more of the examples disclosed above, in some examples, the housing comprises a circular groove, the magnet is disposed partially inside the circular groove, and the housing is configured to rotate around the magnet. Additionally or alternatively to one or more of the examples disclosed above, in some examples, the electronic device further comprises a second magnetic sensing cell attached to the rotating member at a second location of the rotating member and electrically coupled to a switching mechanism, wherein: the switching mechanism is configured to selectively couple one of the first magnetic sensing cell and the second magnetic sensing cell to the first electronic circuit. Additionally or alternatively to one or more of the examples disclosed above, in some examples, the electronic device further comprises a processor configured to: determine a first magnetic field strength based on a signal from the first magnetic sensing cell; determine a second magnetic field strength based on a signal from the second magnetic sensing cell; and in accordance with a determination that the first magnetic field strength is greater than the second magnetic field strength, determine the rotational position of the crown with respect to the body of the electronic device. Additionally or alternatively to one or more of the examples disclosed above, in some examples, the processor is attached to the rotating member.

Some examples of the disclosure are directed to a method of generating a signal corresponding to a rotational position of a crown operatively coupled to a body of an electronic device configured to be worn by a user, the crown comprising a housing, the method comprising: receiving, at an electronic circuit from a first magnetic sensing cell, a first signal corresponding to a position of the first magnetic sensing cell with respect to a magnet configured to remain stationary with respect to the body of the electronic device, wherein: the first magnetic sensing cell is attached to a rotating member disposed at least partially inside the housing, the crown is configured to rotate in a first direction in response to a mechanical input provided by the user, and the rotating member is configured to rotate in the first direction in response to the mechanical input; and generating, at the electronic circuit based on the first signal, a second signal corresponding to a rotational position of the crown with respect to the body of the electronic device. Additionally or alternatively to one or more of the examples disclosed above, in some examples, the first signal corresponds to a strength, at a position of the first magnetic sensing cell, of a magnetic field corresponding to the magnet. Additionally or alternatively to one or more of the examples disclosed above, in some examples, the first electronic circuit is attached to the rotating member and configured to rotate in the first direction in response to the mechanical input. Additionally or alternatively to one or more of the examples disclosed above, in some examples, the magnet is disposed at least partially inside the body of the electronic device. Additionally or alternatively to one or more of the examples disclosed above, in some examples, the magnet is disposed at least partially inside the housing. Additionally or alternatively to one or more of the examples disclosed above, in some examples, the housing comprises a circular groove, the magnet is disposed partially inside the circular groove, and the housing is configured to rotate around the magnet. Additionally or alternatively to one or more of the examples disclosed above, in some examples, a second magnetic sensing cell is attached to the rotating member at a second location of the rotating member and electrically coupled to a switching mechanism, and the switching mechanism is configured to selectively couple one of the first magnetic sensing cell and the second magnetic sensing cell to the first electronic circuit. Additionally or alternatively to one or more of the examples disclosed above, in some examples, the method further comprises determining a first magnetic field strength based on a signal from the first magnetic sensing cell; determining a second magnetic field strength based on a signal from the second magnetic sensing cell; and in accordance with a determination that the first magnetic field strength is greater than the second magnetic field strength, determining the rotational position of the crown with respect to the body of the electronic device. Additionally or alternatively to one or more of the examples disclosed above, in some examples, the electronic circuit comprises a processor attached to the rotating member.

Some examples of the disclosure are directed to an electronic device configured to be worn by a user comprising: means for rotating a crown in a first direction with respect to a body of the electronic device in response to a mechanical input provided by the user; first magnetic sensing means for detecting a first strength of a magnetic field corresponding to a magnet; second magnetic sensing means for detecting a second strength of the magnetic field corresponding to the magnet; means for selectively coupling one of the first magnetic sensing means and the second magnetic sensing means to an electronic circuit; and means for determining, based on an output of the first magnetic sensing means and an output of the second magnetic sensing means, a rotational position of the crown with respect to the body of the electronic device, wherein: the first magnetic sensing means and the second magnetic sensing means are configured to rotate in the first direction in response to the mechanical input provided by the user, and the magnet is configured to remain stationary with respect to the body of the electronic device.

Although examples of this disclosure have been fully described with reference to the accompanying drawings, it is to be noted that various changes and modifications will become apparent to those skilled in the art. Such changes and modifications are to be understood as being included within the scope of examples of this disclosure as defined by the appended claims.

What is claimed is:

1. An electronic device configured to be worn by a user comprising:

a crown operatively coupled to a body of the electronic device and configured to rotate in a first direction with respect to the body of the electronic device in response to a mechanical input provided by the user, the crown comprising a housing;

a rotating member comprising a flexible substrate disposed at least partially inside the housing and configured to rotate in the first direction in response to the mechanical input;

a first magnetic sensing cell attached to the rotating member at a first location of the flexible substrate and electrically connected to a first electronic circuit; and a magnet configured to remain stationary with respect to the body of the electronic device;

wherein the first electronic circuit is configured to generate a first signal corresponding to a rotational position of the crown with respect to the body of the electronic device.

2. The electronic device of claim 1, wherein the first magnetic sensing cell is configured to provide to the first electronic circuit a signal corresponding to a strength, at a position of the first magnetic sensing cell, of a magnetic field corresponding to the magnet.

3. The electronic device of claim 1, wherein the first electronic circuit is attached to the rotating member and configured to rotate in the first direction in response to the mechanical input.

4. The electronic device of claim 1, wherein the magnet is disposed at least partially inside the body of the electronic device.

5. The electronic device of claim 1, wherein the magnet is disposed at least partially inside the housing.

6. The electronic device of claim 5, wherein:
the housing comprises a circular groove,
the magnet is disposed partially inside the circular groove, and
the housing is configured to rotate around the magnet.

7. The electronic device of claim 1, further comprising a second magnetic sensing cell attached to the rotating member at a second location of the rotating member and electrically coupled to a switching mechanism, wherein:
the switching mechanism is configured to selectively couple one of the first magnetic sensing cell and the second magnetic sensing cell to the first electronic circuit.

8. The electronic device of claim 7, wherein the electronic device further comprises a processor configured to:
determine a first magnetic field strength based on a signal from the first magnetic sensing cell;
determine a second magnetic field strength based on a signal from the second magnetic sensing cell; and
in accordance with a determination that the first magnetic field strength is greater than the second magnetic field strength, determine the rotational position of the crown with respect to the body of the electronic device.

9. The electronic device of claim 8, wherein the processor is attached to the rotating member.

10. A method of generating a signal corresponding to a rotational position of a crown operatively coupled to a body of an electronic device configured to be worn by a user, the crown comprising a housing, the method comprising:
receiving, at an electronic circuit from a first magnetic sensing cell, a first signal corresponding to a position of the first magnetic sensing cell with respect to a magnet configured to remain stationary with respect to the body of the electronic device, wherein:
the first magnetic sensing cell is attached to a rotating member comprising a flexible substrate disposed at least partially inside the housing,
the crown is configured to rotate in a first direction in response to a mechanical input provided by the user, and
the rotating member is configured to rotate in the first direction in response to the mechanical input; and
generating, at the electronic circuit based on the first signal, a second signal corresponding to a rotational position of the crown with respect to the body of the electronic device.

11. The method of claim 10, wherein the first signal corresponds to a strength, at a position of the first magnetic sensing cell, of a magnetic field corresponding to the magnet.

12. The method of claim 10, wherein the electronic circuit is attached to the rotating member and configured to rotate in the first direction in response to the mechanical input.

13. The method of claim 10, wherein the magnet is disposed at least partially inside the body of the electronic device.

14. The method of claim 10, wherein the magnet is disposed at least partially inside the housing.

15. The method of claim 14, wherein:
the housing comprises a circular groove,
the magnet is disposed partially inside the circular groove, and
the housing is configured to rotate around the magnet.

16. The method of claim 10, wherein:
a second magnetic sensing cell is attached to the rotating member at a second location of the rotating member and electrically coupled to a switching mechanism, and
the switching mechanism is configured to selectively couple one of the first magnetic sensing cell and the second magnetic sensing cell to the first electronic circuit.

17. The method of claim 16, further comprising:
determining a first magnetic field strength based on a signal from the first magnetic sensing cell;
determining a second magnetic field strength based on a signal from the second magnetic sensing cell; and
in accordance with a determination that the first magnetic field strength is greater than the second magnetic field strength, determining the rotational position of the crown with respect to the body of the electronic device.

18. The method of claim 17, wherein the electronic circuit comprises a processor attached to the rotating member.

19. An electronic device configured to be worn by a user comprising:
means for rotating a crown in a first direction with respect to a body of the electronic device in response to a mechanical input provided by the user;
first magnetic sensing means for detecting a first strength of a magnetic field corresponding to a magnet;
second magnetic sensing means for detecting a second strength of the magnetic field corresponding to the magnet;
means for selectively coupling one of the first magnetic sensing means and the second magnetic sensing means to an electronic circuit; and
means for determining, based on an output of the first magnetic sensing means and an output of the second magnetic sensing means, a rotational position of the crown with respect to the body of the electronic device, wherein:
the first magnetic sensing means and the second magnetic sensing means are disposed on a flexible substrate and are configured to rotate in the first direction in response to the mechanical input provided by the user, and
the magnet is configured to remain stationary with respect to the body of the electronic device.

* * * * *